US006509126B1

(12) United States Patent
Whitesides et al.

(10) Patent No.: US 6,509,126 B1
(45) Date of Patent: Jan. 21, 2003

(54) PHOTOTHERMOGRAPHIC ELEMENT COMPRISING A FLUORESCENT DYE AND METHODS OF IMAGE FORMATION

(75) Inventors: Thomas H. Whitesides, Rochester, NY (US); John H. Hone, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/032,870

(22) Filed: Dec. 28, 2001

(51) Int. Cl.[7] ..... G03C 1/498; G03C 5/16; G03C 11/00

(52) U.S. Cl. ..... 430/21; 430/139; 430/350; 430/566; 250/486.1; 250/580; 250/581

(58) Field of Search ..... 430/21, 619, 139, 430/566, 350; 250/580, 581, 486.1

(56) References Cited

U.S. PATENT DOCUMENTS

| | | |
|---|---|---|
| 4,543,308 A | 9/1985 | Schumann et al. |
| 5,334,469 A | 8/1994 | Sutton et al. |
| 5,350,650 A | 9/1994 | Gasper et al. |

FOREIGN PATENT DOCUMENTS

| | | |
|---|---|---|
| EP | 0 702 483 A2 | 3/1996 |

*Primary Examiner*—Thorl Chea
(74) *Attorney, Agent, or Firm*—Chris P. Konkol

(57) ABSTRACT

The present invention is directed to a photothermographic imaging element comprising at least one silver halide imaging layer containing a fluorophore. The imaging element can be exposed and then processed by heating to form an image in which the intensity of the fluorescence from the element is modulated imagewise to yield a fluorescent image of the light intensities to which the element was exposed. The present invention is also directed to a method of processing photothermographic film that has been imagewise exposed in a camera, which method in order comprises thermally developing the film step without any externally applied developing agent, comprising heating said film to a temperature greater than 80° C., preferably in an substantially dry process, and detecting the luminescence latent image emitted by a fluorescent dye associated with at least one imaging layer and, based thereon, providing a digital electronic record, wherein substantial amounts or all of the silver and silver halide salts in the film are not removed before detection. A preferred embodiment of the invention is directed to a color photothermographic film.

39 Claims, 4 Drawing Sheets

_____ (Solid line) Intensity ($10^{-11}$W) of Blue Emission

___ . ____ (Dotted Line) Intensity ($10^{-11}$W) of Green Emission (Shaded) Insufficient Color Information

PHOTOTHERMOGRAPHIC ELEMENT COMPRISING A FLUORESCENT DYE AND METHODS OF IMAGE FORMATION

FIELD OF THE INVENTION

The invention describes a photothermographic element and a method of producing a scannable photographic image therefrom, wherein the image information in at least one color record is recorded by detecting light in a first spectral region generated by fluorescence excited within the film on exposure of the developed image to substantially monochromatic light in a second spectral region.

BACKGROUND OF THE INVENTION

In conventional photography, an image is recorded on a photographic film, and the film is then processed by immersion in a sequence of processing solutions to provide a record of the light intensities in the original scene as modulations of the concentration of a colored material in the film structure. In the case of a black and white image, the record is usually of the overall intensity of visible light, and the colored material is typically metallic silver formed by imagewise development. Typically, in a full-color process, the record is separately the red-, green-, and blue-light information in the original scene, recorded in variations in the concentration of cyan, magenta, and yellow dyes in the film. The image information so recorded is then either viewed directly (as in a slide for projection), or used to print a second image for viewing (as in the production of a print from a photographic negative).

One of the limitations of conventional photography is color correction. In the case of a slide image, no corrections for color rendition, minimum density, image contrast, or the like are possible once the processing is done; the image is essentially viewed directly. Even in the case of the color print, only certain corrections for improving image quality can be achieved, with difficulty, by manipulation of the color chemistry of the film or the print or by adjusting the printing parameters (exposure, color balance, etc.).

Another limitation of conventional photography is volume of chemicals consumed during processing, posing problems in transport, handling, and disposal. It is always desirable to limit the amount of solvent or processing chemicals used in the processing of silver-halide films. As indicated above, a traditional photographic processing scheme for color film involves development, fixing and bleaching, and washing, each step typically involving immersion in a tank holding the necessary chemical solution.

By the use of a photothermographic film, it would be possible to eliminate processing solutions altogether, or alternatively, to minimize the amount of processing solutions and the complex chemicals contained therein. A photothermographic (PTG) film by definition is a film that requires energy, typically heat, to effectuate development. A dry photothermographic film requires only heat. In some embodiments, a solution-minimized photothermographic film may require small amounts of aqueous alkaline solution to effectuate development, which amounts may be only that amount required for swelling the film without excess solution. However, completely dry photothermographic processes are generally preferred.

Photothermographic film has typically been scanned, offering the opportunity for enhanced color correction. Acquisition of image information by electronic scanning and digitization is a routine feature of modern imaging technology. If the captured image is first digitized, a much wider range of image modification is possible by computer manipulation of the image file. At the same time, visually satisfactory images can be constructed from digital information recorded from images on film that would be inadequate for normal viewing or printing. In photothermographic films, since the silver is retained, film images have high minimum optical densities ($D_{min}$). These images can be readily digitized, and manipulated to yield more attractive prints than would be possible using conventional optical printing.

In addition to color correction, another advantage of scanning is that, while in conventional color photography, the image dyes that record the color records are invariably cyan, magenta and yellow, dyes of a much wider range of colors are usable with a suitable scanner. They can be false-colored, for example, so that the red light information is recorded in density of an IR absorbing dye. It is even possible that the dyes corresponding to two different color records can have absorption spectra that overlap substantially, or be sensitized in such a way that there is some mixing of the RGB information in the scene as it is recorded on the film. Algebraic manipulation of the digitized image can be used to compensate in large part for this overlap or the color mixing, so that the true red, green, and blue (RGB) light levels in the original scene can be reconstructed even from these partially convoluted data.

Most digitization schemes involve the same kind of information that is normally used in conventional processing, namely the modulation of a transmitted light beam by light absorption by the dyes incorporated imagewise into the developed image. However, digitization allows completely new ways of gathering the data necessary for reconstructing a visually satisfying image. Various schemes have been proposed. For example, partially reflective, absorbing, or reflective interlayers can aid in the isolation of color records that are all imaged in the same hue (for example, in a silver gray-scale). This kind of image recording scheme has been proposed, for example, in U.S. Pat. Nos. 5,334,469, 5,350,651, 5,350,664, 5,389,503 and 5,418,119. Another approach to the same goal is to use fluorescent interlayers; this method has been proposed in U.S. Pat. No. 5,350,650 and EP 0 702 483 A2.

Another way of recording images has been disclosed by Schumann et al., in U.S. Pat. No. 4,543,308, who used fluorescence from retained sensitizing dye to record imagewise information from a number of color film and paper formats. Schumann et al. noted certain advantages of a fluorescent imaging scheme over an imaging system based on dye absorption. For example, detection of fluorescence can be done at extremely low levels, so that only very small amounts of fluorophore would be necessary for imaging. The fluorophore could take the place of much larger quantities of expensive dye-forming couplers in the conventional approach, so that the film would be less expensive to manufacture. Further, the small amounts of imaging fluorophore would allow coating of substantially thinner film structures, with possible improvements in image structure and manufacturing economy. However, the elements of Schumann et al. are all developed by conventional means and do not involve images generated by thermal development.

Schumann et al., in the process of U.S. Pat. No. 4,543,308, preferably does not remove (bleach) retained silver prior to image detection. Schumann et al. attributes fluorescent imaging to at least two factors, the first of which is image-wise quenching of the luminescence by the silver image. Schumann notes, however, that fluorescent imaging can occur, at least in some cases, if the silver image is removed. In the only working example (Example 9) in which silver is removed, imagewise formation of color dyes are present that apparently modulate the fluorescence. Schumann et al. mention that fixing is optional, but preferred. All of the working examples in Schumann et al. have been washed, so that they contain none of the water-soluble processing chemicals such as developers, bleaching agents, and the like.

PROBLEM TO BE SOLVED BY THE INVENTION

In view of above, all of the cases in which fluorescent imaging has been used for recording image information have involved wet chemical means to develop and/or produce an image to modulate the fluorescence. Fluorescence imaging in a thermally processed film has not previously been accomplished. Such an imaging scheme would require that fluorescent materials be sufficiently compatible with the high temperature processing conditions and the chemical components uniquely present in photothermographic elements. The fluorescent materials ("fluorophores") would need to be capable of withstanding high temperatures in the presence of the complex set of chemicals necessary to cause silver development in a photothermographic element, even though fluorophores tend to be large, sensitive, and reactive entities. Chemical components present in photothermographic elements, but not present in conventional systems, may include, for example, organic silver salts, melt formers, and blocked developers or other compounds that generate reactive intermediates during thermal development. It has never been determined whether a fluorescent latent image would form or would be detectable in a photothermographic element, rather than being quenched or obscured by the above-mentioned chemicals components or by other film constituents that might interfere, including components such as developing agents in both reduced and oxidized form that would have been washed out in conventional processing.

In U.S. Pat. No. 4,543,308 to Schumann et al., imaging in multilayer color photographic materials used either separation exposures or white light exposures. Furthermore, all of the white light exposures corresponded to bleach-fixed materials. Schumann et al., therefore, did not actually demonstrate that color imaging is possible in conventional film, let alone in film where the cross-talk between unfixed layers is large. In photothermographic film that is unbleached and unfixed, any fluorescence image would need to be viewed in the presence of, and through, the highly scattering and absorbing layers of other colors.

Finally, Schumann et al. taught that most of the fluorescent latent image appears with low levels of silver and silver development. This observation suggests that the fluorescent latent image would likewise be sensitive to low fog levels. Photothermographic elements, especially chromogenic elements, suffer from the presence of substantial fog, which conceivably could adversely effect a fluorescent image scale. Despite the various unknowns and potential problems, achieving fluorescent imaging in a photothermographic material would be highly desirable.

The advantages of such fluorescent imaging would be especially apt for a photothermographic element, in contrast to conventional film, since according to Schumann et al. no fixing and bleaching are required and since in photothermographic film, no wet development is necessary. Therefore, no wet processing at all would, therefore, be necessary in photothermographic film, as compared to the process taught by Schumann et al. With respect to conventional films, since wet development is required anyway, the absence of fixing and bleaching would not be as advantageous and may even be undesirable for reasons of remediation. In contrast, with respect to photothermographic systems, the absence of wet development would allow the use of kiosks for speedily providing imaged prints to customers using a dry process, while optionally allowing later remediation using wet processing.

SUMMARY OF THE INVENTION

The present invention describes a photothermographic imaging element comprising at least one silver halide imaging layer containing a fluorescent substance ("fluorophore"), which imaging element can be exposed and then processed by heating to form an image in which the intensity of the fluorescence from the element is modulated imagewise to yield a fluorescent image of the light intensities to which the element was exposed. The fluorescent image can then be digitized using a suitable digital detecting device, such as a scanner, and digitally processed and printed to yield a visually accessible image of the original data (that is, a photographic image).

The term "scanner" as used herein refers to a device for forming image-bealing electronic signals from two-dimensional images, and the term "scanning" as used herein refers to the process of translating a photograph film into an electronic form that can be used by computers. Preferably, the scanner is also capable of converting the electronic signals to digital form. In a preferred embodiment, scanners comprise one or two-dimensional CCD array detectors.

A preferred embodiment of the invention is directed to a color photothermographic film having at least three light-sensitive units which have their individual sensitivities in different wavelength regions, each of the units comprising at least one light-sensitive silver-halide emulsion, one or more organic silver salts, and binder, and a developing agent or precursor thereof.

The present invention is also directed to a method of processing photothermographic film that has been image-wise exposed in a camera, which method in order comprises: (a) thermally developing the film step without any externally applied developing agent, comprising heating said film to a temperature greater than 80° C. in an substantially dry process, and (b) detecting the luminescence latent image emitted by a fluorescent dye associated with at least one imaging layer (any one or all of the color light-sensitive units in a color film) and, based thereon, providing a digital electronic record capable of generating a positive image in a display element, wherein substantial amounts or all of the silver and silver halide salts in the film are not removed before detection. Thermal activation preferably occurs at temperatures ranging from about 80 to 180° C. In one embodiment of the invention, at least initial processing is accomplished in a kiosk.

Advantageously, it has been found that the presence of retained silver halide in the photothermographic element during luminescence detection is not only optional, but significantly improves the quality of the luminescent image, even in the event of small amounts of thermal fog commonly associated with photothermographic elements.

DETAILED DESCRIPTION OF THE INVENTION

Figure 1:
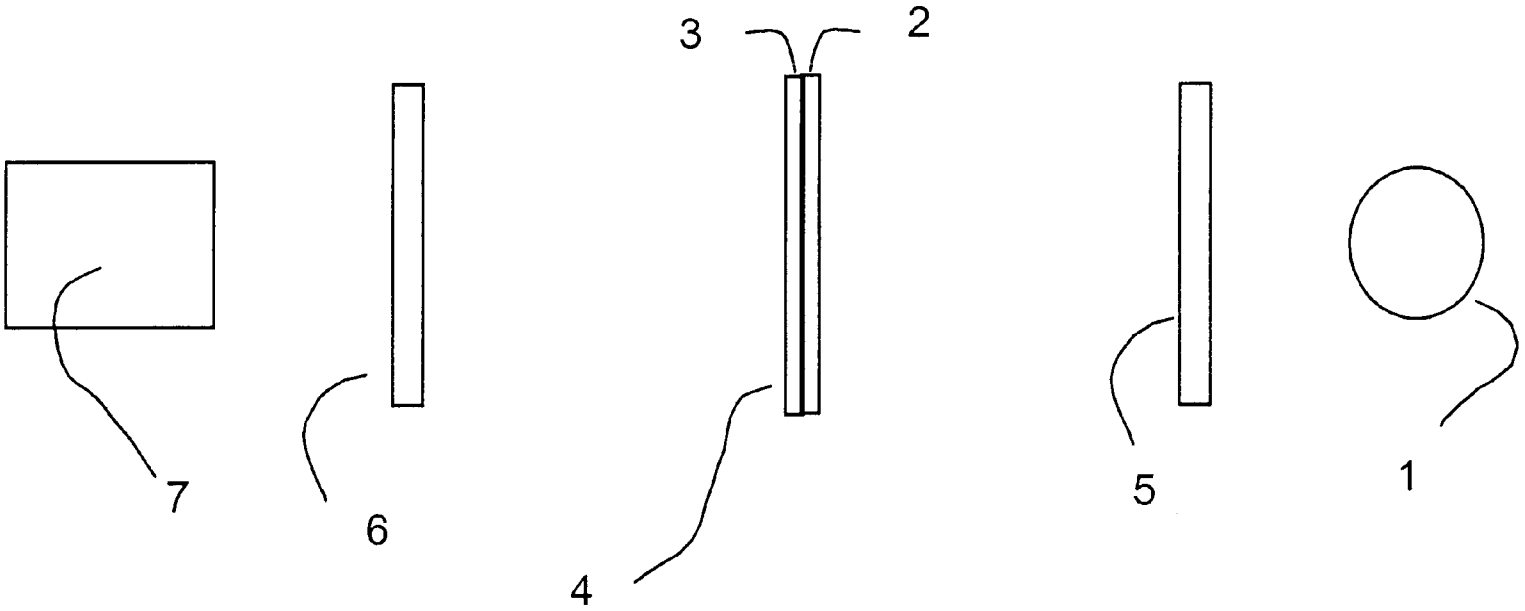
FIG. 1 shows, in block diagram, one embodiment of a system for detecting fluorescent latent image information and forming a picture.

In the present invention, light-intensity input or capture information is at least partially acquired by fluorescence imaging. This is a technique in which the light intensity information in the original scene, after capture, is detected as spatial variations (modulations) of light emitted by fluorescent materials immobilized in a two-dimensional film structure. More particularly, the present invention involves a fluorescent film in which the modulation of the fluorescence intensity can be achieved in a thermally processable silver-halide imaging element. Preferably, this element comprises at least three imaging layers coated on a support, at least one layer comprising a light-sensitive silver-halide emulsion, an incorporated developer, and a fluorescent compound.

The preferred embodiment involves color imaging. As in conventional chromogenic silver-halide imaging, recording a color image by means of the present invention requires the acquisition of light intensity information in three different regions of the visible spectrum, for example in the red, green and blue region, together with the ability to use the intensity information to create a rendition of the original scene in which the light intensities are reproduced. The reproduction (for final viewing) can be either in red, green, and blue light (as in an image formed on a computer screen) or in levels of cyan, magenta, and yellow dyes if the image is to be viewed, for example, as a photographic print on a white reflective support.

As indicated above, a photothermographic element according to the present invention comprises a least one silver-halide imaging layer containing a fluorescent compound or "fluorophore." A fluorophore is a compound that is capable of absorbing light in some region of the spectrum, and then emitting light at a second, longer wavelength region with reasonable efficiency.

Although the fluorophore can be a spectral sensitizing dye, preferably it is not, since the ability of a spectral sensitizing dye depends on its ability to form a J aggregate, which is not important for fluorescent imaging. Instead, the fluorophore is preferably selected to (1) exhibit high absorptivity of exciting light which allows the use of minimal amounts of the fluorophore, (2) exhibit high quantum yield for emission, preferably more than exhibited by spectral sensitizing dyes, since to the extent a spectral sensitizing dye emits, it is not sensitizing, (3) exhibit thermal stability, (4) exhibit a large Stokes shift, (5) exhibit a narrow absorption band, and (6) exhibit a narrow emission band.

In one embodiment, the fluorophore exhibits a molar extinction coefficient greater than $10^4$ liters/mole-cm, the fluorophore exhibits a quantum yield for emission of greater than one percent, preferably more than ten percent, the Stokes shift of the fluorophore is greater than 10 nanometers, preferably greater than 30 nanometers, the fluorophore exhibits an absorption band of less than 100 nm, and the fluorophore exhibits an emission band of less than 150 nm. Not all these requirements must be met in a given fluorophore, although a high quantum yield for fluorescence emission is important. Suitably, a fluorophore is used in the amount of $10^{-9}$ to $10^{-3}$ mol/m$^2$, preferably $10^{-8}$ to $10^{-6}$ mol/m$^2$ in an imaging layer.

In one preferred embodiment of the present invention, this imaging element is used as an image capture medium in a camera to record light from a scene, and then thermally processed. The processed element is then illuminated in such a way as to excite the fluorescence of one or more of the fluorescent compounds in the layer or layers, and the emitted light is captured by a digital capture device such as a scanner or CCD (charge-coupled device) linear array to provide a digital image. The digital image, after appropriate processing by a computer, can then be used to drive any kind of digital output device, such as an ink-jet printer, a thermal dye-transfer printer, a laser exposure device for a photographic printer, or to provide an image on a video display device.

The concept of the present invention, and some of its advantages, can be illustrated in terms of a simple one-layer structure containing the critical elements listed above: a light-sensitive silver halide emulsion, an incorporated developer, and a fluorophore. In regions of the film that are exposed to high intensities of light from the scene ($D_{max}$ areas), formation of latent image on the incorporated silver halide grains will occur, so that during thermal processing in the presence of the incorporated developer, metallic silver will be formed. In areas of the scene that are dark ($D_{min}$ areas), little or no latent image is created during exposure, so that little or no metallic silver is formed during development. Addenda to enhance the formation of the silver image are helpful in order to obtain a marked distinction between $D_{max}$ and $D_{min}$; that is, to obtain good image discrimination. For example, silver donors (moderately soluble silver salts that contribute silver ions to the development process by physical development) can be used, along with melt formers, plasticizers, antifoggants, development accelerators, base releasers, and the like, can be used to enhance the image forming step, and to provide a large distinction between areas of high and low exposure. The reduction of silver ion to silver metal is accompanied in the film by the formation of oxidized developer, which, in a conventional process, is used to form a light-absorbing dye that is used for imaging purposes. In the present invention, the oxidized developer could be used instead to destroy the fluorophore in an imagewise fashion, or similarly to create a fluorophore imagewise from a non-fluorescent precursor. It is also possible that no reaction of any kind will occur between oxidized developer and the incorporated fluorescent compound, and that the image discrimination will be obtained purely by a physical means, as we now describe.

It should be noted that in this thermally processed scheme, the removal of either non-exposed silver halide or of the developed silver does not occur, at least prior to image detection. Thus, the exposed areas of the film will comprise silver particles together with some portion of undeveloped silver halide, whereas the unexposed ($D_{min}$) areas will comprise essentially only undeveloped silver halide. The silver particles are dark, and thus will absorb light of all visible wavelengths, whereas the silver halide particles absorb only a small amount of light, and are highly scattering. When the exposed and processed film sample is exposed to light of a wavelength absorbed by the fluorophore, the presence of these scattering centers within the layer increases the effective optical path length, thus enhancing the probability that the incident light will be absorbed by the fluorescent dye. In the $D_{min}$ areas, therefore, the fluorescent dye is relatively efficiently excited. In $D_{max}$ areas, on the other hand, the presence of the highly absorbing silver metal particles prevents efficient excitation. Likewise, when the fluorophore emits a photon, in the $D_{min}$ areas, the photon is rapidly scattered out of the structure, where it can be detected by the scanner or CCD camera. In the $D_{max}$ area, the photon has a high probability of being absorbed by a silver particle before escaping the film. Without wishing to be bound by theory, we surmise that this physical mechanism is responsible for much of the modulation of the intensity that is observed. However, it is also possible that the fluorophore is destroyed in part by reaction with the oxidized developer. If this reaction were to occur, and the product of the reaction were non-fluorescent, further enhancement of image discrimination would be expected.

The oxidized developer can contribute to image formation in another way as well. In the absence of scavengers (for example, coupler) for reaction with oxidized developer, the molecule can decompose in the film to yield highly colored organic products. These colored materials also contribute to image formation, by absorbing both exciting and emitted light in an imagewise fashion. No matter what the detailed imaging mechanism is, however, the imaging elements of the invention have been found to exhibit good image discrimination as detected by the intensity of emitted fluorescent light.

A full-color imaging element can be constructed by the superposition on a support of single layer elements similar to that discussed above. Each layer comprises an appropriately sensitized silver halide emulsion, incorporated developer, and a fluorophore. Three different fluorophores would be used, each with different excitation and emission properties. The basic features of the invention can be appreciated by considering the construction and use of a multicolor photothermographic element satisfying the following Structure I. This structure, and the discussion that follows, is intended to be illustrative only, and both the structure and the discussion of its function is made very simple for this purpose; many modifications of the basic approach can be envisaged.

STRUCTURE I

| | |
|---|---|
| BU | Blue sensitive AgX |
| | Blue absorbing, green emitting fluorophore |
| | Incorporated Developer |
| IL | Yellow filter dye layer |
| GU | Green sensitive AgX |
| | Green absorbing, red emitting fluorophore |
| | Incorporated developer |
| RU | Red sensitive AgX |
| | Red absorbing, infrared emitting fluorophore |
| | Incorporated developer |
| S | Support |

In this embodiment, after exposure and thermal processing, this element would be illuminated, in three separate steps, by light capable of exciting each of the three fluorophores. Blue light would excite the blue-absorbing fluorophore in the top layer, so that the green emission from this fluorophore would be modulated strongly by the development of silver in that layer. Correspondingly, green light excitation should excite the fluorophore in the green-sensitive layer, resulting in emission in the red region of the spectrum that would be modulated by silver development in the green layer. Likewise, red light excitation and infrared detection should yield primarily information about the red layer.

Depending on the geometry of the illumination and detection system, either or both of the excitation and emission beams will pass through more than one layer. For example, consider a linear detection system (such as that shown schematically in FIG. 1) in which all of the exciting light from light source 1 passes through an interference filter 5 which passes a narrow band of light in the region that excites the fluorophore in the film. After passing through the interference filter 5, the excitation light passes through the support 2 and image layers 3 of film 4; that is, the structure is illuminated from the bottom of the film shown in Structure I above. In order to excite the fluorophore in the blue record (BU), the exciting light must pass through both the red- and the green-sensitive layers (RU and GU). Because the silver image in these layers will absorb blue light imagewise, the excitation intensity in the blue record will contain information about red and green layer exposure that will be reflected in the output intensity. Similarly, the light emitted by the fluorophore in the red layer (RU) must pass through the green and blue layers (GU and BU) in order to be detected in this scheme, and its intensity will, therefore, be modulated by the presence of silver in those layers. The light emitted by the fluorophores in film 4 then impinges on the interference filter 6 which rejects the wavelength that is opaque to the excitation light but allows passage of the light emitted by the fluorophore. This light is then recorded by scanner 7.

The blue light coming from the underside of the layer will be strongly absorbed by the yellow filter dye layer, for which reason, it might be preferable (in an alternative embodiment) to illuminate the front face of the structure with blue light, or at least to use a dye in the top layer that can be excited efficiently at a longer wavelength than that absorbed by the yellow filter layer.

Three different sets of interference filters 5 and 6 are employed in order to acquire three separate channels containing information about green, red, and blue exposures. Each set of filters are selected to obtain an optimal response from the fluorophores in the corresponding color layer. The film is, therefore, scanned sequentially using each set of filters to obtain three color R, G, B records in FIG. 2.

In any case, it is to be expected that the recorded red, green, and blue fluorescence intensities will not purely reflect the exposure in red, green, and blue light (the RGB signal), but will instead be different functions of exposure in all three colors. Computer manipulation is, therefore, required to recover the RGB exposure information from the fluorescence intensity information. This situation is encountered in conventional photographic systems as well, where silver development is coupled to dye formation, particularly in systems where the developed silver is not removed.

An advantage of the fluorescence imaging of the present invention is that there is more flexibility in detector design, and in the choice of emission and excitation wavelengths, so that deconvolution of the RGB exposure signals can be better optimized. For a system depending on light absorption by a set of three dyes for color discrimination, a linear optical scheme is usually employed, where white light passes through the support, then the imaging layers containing dyes, and then through each of a set of filters. The detector (a CCD camera or similar device) then records the transmitted light intensity as a function of position on the element. There is only a single degree of freedom (the transmission maxima of the filter set) in the optimization of the detector response. In contrast, with fluorescence imaging, for each record, it is possible to adjust two wavelengths so as to optimize the response of the detector and the separation among color records. In addition, the excitation light can illuminate the processed film from either side (from the front or through the support). It is also possible to supplement the measurement of fluorescence intensity by absorption measurements. For example, the total developed silver in all three records could be measured by the absorption of light in transmission through the entire structure, using the same detector and light source as in the fluorescence intensity measurement, but without the emission filter in the optical path. This information could be used to supplement the fluorescence intensity measurements, and allow more accurate separation of the RGB information.

Many other structures, besides Structure I, can be used to achieve full-color imaging, as would be apparent to one skilled in the art, so long as at least one layer utilized the unique combination of the present invention. For example, any of the structures given by Evans, Rider and Simons in U.S. Pat. No. 5,350,651 could be used. In many of these structures, the red, green, and blue imaging layers form colors of the same hue (usually black) on processing, and the RGB information is obtained by reading out fluorescent light from fluorescent dyes in interlayers interposed between the imaging layers. Hybrid structures or image acquisition processes could also be used as indicated above, in which combinations of fluorescence emission and light absorption by dye and/or silver are used to enhance imaging or color record separation. One example of such a hybrid process is described above, in which light absorption by developed silver is used to supplement fluorescence imaging information. A similar role could be played by dye formed imagewise in one or more layers of the film, where light absorption by that dye could supplement fluorescence imaging information to obtain enhanced color record separation after computer manipulation.

Any fluorophore that can survive the thermal processing conditions is useful in this invention, including fluorophores listed in U.S. Pat. No. 4,543,308 to Schumann et al., particularly in col. 10 ff; and in U.S. Pat. No. 5,350,650 to Gasper et al., in Table II, columns 14–17). Other examples are in Table XX below. Methine, trimethine, and pentamethine oxonol dyes are particularly preferred fluorophores. In many cases, the emulsion sensitizing dye is sufficiently fluorescent to allow fluorescence imaging without addition of any further fluorophore. Several sensitizing dyes are described by Gaspar, et al. (loc.cit.); the structures shown in Table XX below have been found to be particularly useful in this invention.

Non-imaging silver salts act as sources for physically developable silver during thermal processing, and include silver carboxylates such as silver behenate, silver benzotriazole, and other relatively insoluble silver salts.

As indicated above, the invention relates to a dry photothermographic process employing blocked developers that decompose (i.e., unblock) on thermal activation to release a developing agent. In dry processing embodiments, thermal activation preferably occurs at temperatures between about 80 to 180° C., preferably 100 to 160° C.

By a "dry thermal process" is meant herein a process involving, after imagewise exposure of the photographic element, developing the resulting latent image by the use of heat to raise the temperature of the photothermographic element or film to a temperature of at least about 80° C., preferably at least about 100° C., more preferably at about 120° C. to 180° C., without liquid processing of the film, preferably in an essentially dry process without the application of aqueous solutions. By an essentially dry process is meant a process that does not involve the uniform saturation of the film with a liquid, solvent, or aqueous solution.

Preferably, during thermal development an internally located blocked developing agent in reactive association with each of three light-sensitive units becomes unblocked to form a developing agent, whereby the unblocked developing agent is imagewise oxidized on development.

This thermal development typically involves heating the photothermographic element until a developed image is formed, such as within about 0.5 to about 60 seconds. By increasing or decreasing the thermal processing temperature a shorter or longer time of processing is useful. Heating means known in the photothermographic arts are useful for providing the desired processing temperature for the exposed photothermographic element. The heating means is, for example, a simple hot plate, iron, roller, heated drum, microwave heater, heated air, vapor or the like. Thermal processing is preferably carried out under ambient conditions of pressure and humidity. Conditions outside of normal atmospheric pressure and humidity are useful.

It is necessary that the components of the photographic combination be "in association" with each other in order to produce the desired image. The term "in association" herein means that in the photothermographic element the photographic silver halide and the image-forming combination are in a location with respect to each other that enables the desired processing and forms a useful image. This may include the location of components in different layers.

Preferably, development processing is carried out (i) for less than 60 seconds, (ii) at the temperature from 120 to 180° C., and (iii) without the application of any aqueous solution.

Dry thermal development of a color photothermographic film for general use with respect to consumer cameras provides significant advantages in processing ease and convenience, since they are developed by the application of heat without wet processing solutions. Such film is especially amenable to development at kiosks or at home, with the use of essentially dry equipment. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

Details of useful scanning and image manipulation schemes are disclosed in co-filed and commonly assigned U.S. Ser. No. 09/592,836 (docket 81094) and U.S. Ser. No. 09/592,816 (docket 81040), both hereby incorporated by reference in their entirety.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443. Method for the scanning of such films are also disclosed in commonly assigned U.S. Ser. No. 60/211,364 (docket 81246) and U.S. Ser. No. 60/211,061 (docket 81247), hereby incorporated by reference in their entirety.

Once distinguishable color records have been formed in the processed photographic elements, conventional techniques can be employed for retrieving the image information for each color record and manipulating the record for subsequent creation of a color-balanced viewable image.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in Ser. No. 09/592,816 (Docket 81040) titled AN IMAGE PROCESSING AND MANIPULATION SYSTEM to Richard P. Szajewski, Alan Sowinski and John Buhr.

For illustrative purposes, a non-exhaustive list of photothermographic film processes involving a common dry heat development step are as follows:

1. heat development=>scan=>stabilize (for example, with a laminate)=>scan=>obtain returnable archival film.

2. heat development=>fix bath=>water wash=>dry=>scan=>obtain returnable archival film 3. heat development=>scan=>blix bath=>dry=>scan=>recycle all or part of the silver in film 4. heat development=>bleach laminate=>fix laminate=>scan=>(recycle all or part of the silver in film)

5. heat development=>bleach=>wash=>fix=>wash=>dry=>relatively slow, high quality scan A typical color negative film construction useful in the practice of the invention is illustrated by the following element, SCN-1:

ELEMENT SCN-1

| | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly(ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of Research Disclosure I.

Photographic elements of the present invention may also usefully include a magnetic recording material as described in Research Disclosure, Item 4390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion fluorophore. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 $\mu$m (most preferably less than 0.2 $\mu$m). Ultrathin tabular grain emulsions, those with mean tabular grain thickness of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters, ethers, and both anionically and cationically substituted cellulosics), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 $g/m^2$ of silver. Silver quantities of less than 7 $g/m^2$ are preferred, and silver quantities of less than 5 $g/m^2$ are even more preferred. The lower quantities of silver improve the optics of the elements, thus enabling the production of sharper pictures using the elements.

The interlayers IL1 and IL2 are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate a reducing agent capable of reacting with oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains light absorbing material, such as one or a combination of pigments and dyes that can absorb exposing light that is not utilized by the emulsion layers to produce developable silver halide. Thermally bleachable compounds are particularly preferred for the present invention. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image which, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The photothermographic elements of the present invention are preferably of type B as disclosed in *Research Disclosure* I. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075, 4,459,350; 4,264,725 and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-metbyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two heteroatoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolai blend of a silver behenate with behenic acid, prepared by precipitation from aqueous solution of the sodium salt of commercial bebenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76. Suitably, the amount of silver in the imaging layer is 0.04 $g/m^2$ to 4 $g/m^2$, preferably 0.2 $g/m^2$ to 2 $g/m^2$.

Because in one embodiment of the invention only silver development is required, color developers (p-phenylene diamines or p-aminophenolics) are not obligatory. Other developers that are capable of forming a silver image may also be used, without regard to their ability to form a colored dye. Such developers include, in addition to p-phenylene diamine developers and substituted p-arninophenols (3,5-dichloroaminophenol and 3,5-dibromoaminophenol are particularly preferred choices) but also p-sulfonamidophenols, ascorbic acid, low valent metal compounds, particularly those containing Fe(II), Cu(I), Co(II), Mn(II), V(II), or Ti(III), hydrazine derivatives, hydroxylamine derivatives, phenidones. For incorporated developers, thermally unblocking blocked developers are preferred.

A reducing agent in addition to the blocked developer may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-pbenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e. g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene, bisphenols, e.g., bis(2-hydroxy-3-t-butyl-5-methylphenyl)-methane; 2,2-bis(4-hydroxy-3-methylphenyl)-propane, 4,4-ethylidene-bis(2-t-butyl-6-methylphenol), and 2,2-bis(3,5-dimethyl-4-hydroxyphenyl) propane, ascorbic acid derivatives, e.g., 1-ascorbyl-palmitate, ascorbylstearate and unsaturated aldehydes and ketones, such as benzyl and diacetyl, pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described phototheimographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like, and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A pbotothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed in commonly assigned, co-pending U.S. patent applications Ser. Nos. 09/206586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. However, conditions outside of normal atmospheric pressure and humidity are useful under certain circumstances, and can aid in the formation of a useful image. Processing under conditions of elevated humidity can be particularly beneficial.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

Once the fluorescent image has been formed in the processed photographic elements of the invention, a variety of techniques can be employed for retrieving the image information for each color record and manipulating the record for subsequent creation of a color-balanced viewable image. In what follows, it will be assumed for convenience that the fluorophores in the three color records are excited by light in the blue, green, and red regions of the spectrum respectively, though, as pointed out above, other kinds or regions could also be used if convenient. Likewise, the emitted light will be assumed to be principally green from excitation with blue light (blue record), red from excitation with green light (green record), and infrared from excitation with red light (red record). Once again, however, the regions corresponding to the emitted light will be those that optimize the response of the processed and exposed image, and may not correspond to these designations. It will be true that the emitted light is in some longer wavelength region than the exciting light. With this definition in mind, it is possible to scan the photographic element successively within exciting light in the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light emitted by the element at a scanning point is detected through an appropriate emission filter by a sensor that converts radiation received into an electrical signal. The emission filter used is preferably one that optimizes detection of the emitted light and/or the separation of color record information. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth. In yet another embodiment, the electronic signal is generated by the use of a CCD camera. In this case, the image information is captured in three separate exposures, through three different combinations of exciting and emission filters. Combinations of this scheme with scanning is also possible, as are schemes in which illumination and/or signal generation are accomplished line-by-line, rather than pixel-by-pixel, so that scanning takes place in only one dimension. Note that it is not always necessary to use different filters for each color record, as long as one of the pair of emission and excitation is different. For example, a single excitation filter could pass light in a relatively short wavelength band that excites fluorescence in some or all of the fluorophores in each layer, so that it is conceivable that only one excitation wavelength band is necessary. Alternatively, two excitation filters, or three, can be used to obtain an optimal set of data for reconstruction of the color-corrected information. It is even possible to use more than three sets of filters, and, as pointed out above, to combine fluorescence information with light absorption information in order to obtain good image reproduction.

It is contemplated that imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering. Coating on a translucent, scattering support can also accomplish this purpose.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793, Klees U.S. Pat. Nos. 4,694,342 and 4,962,542; Powell U.S. Pat. No. 4,805,031, Mayne et al U.S. Pat. No. 4,829,370; Abdulwahab U.S. Pat. No. 4,839,721; Matsunawa et al U.S. Pat. Nos. 4,841,361 and 4,937,662, Mizukoshi et al U.S. Patent 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255, Osamu et al U.S. Pat. No. 5,051,842, Lee et al U.S. Pat. No. 5,012,333, Bowers et al U.S. Pat. No. 5,107,346, Telle U.S. Pat. No. 5,105,266, MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

Figure 2:
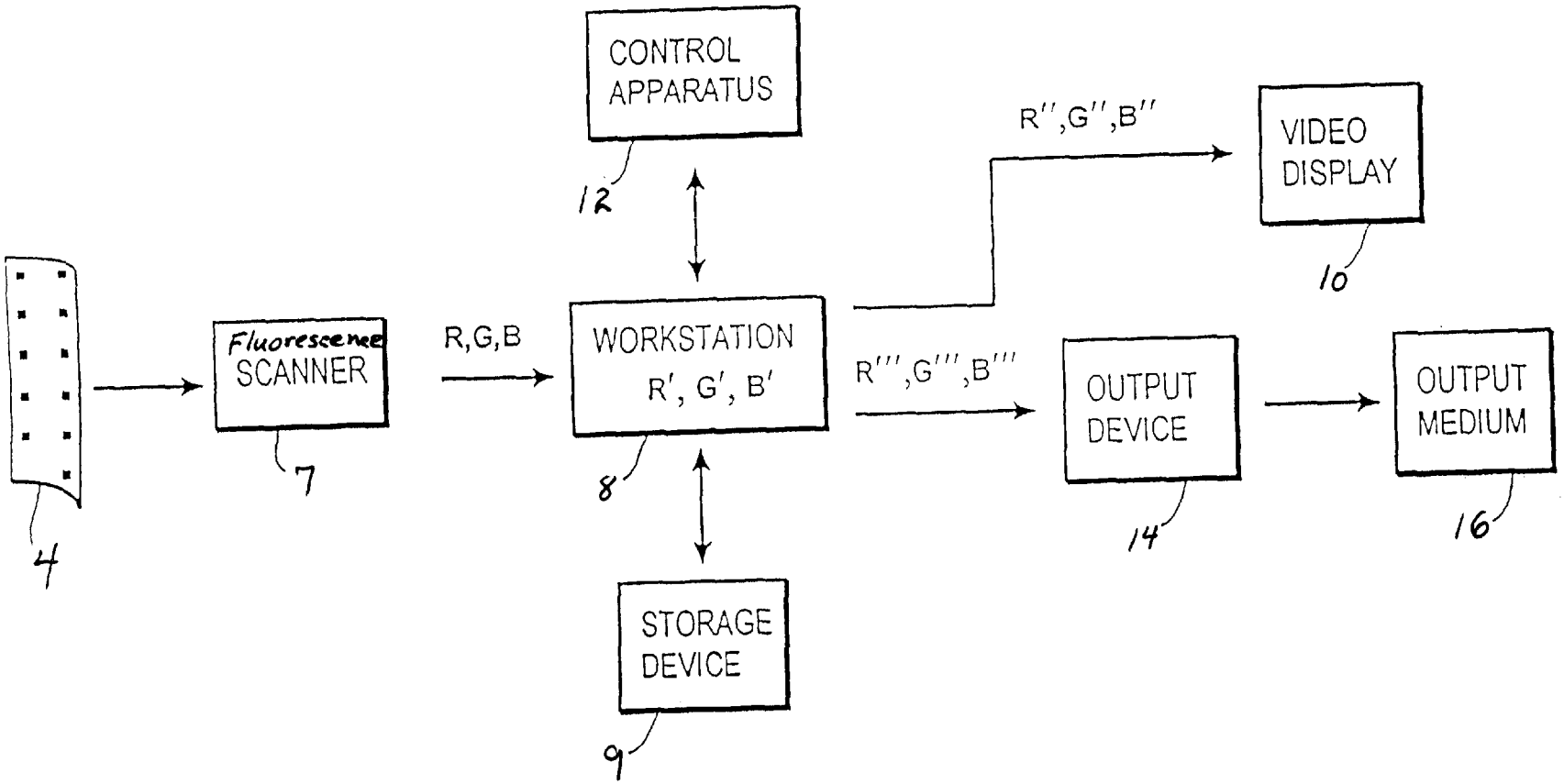
FIG. 2 shows, in block diagram form, an apparatus for processing and viewing image formation obtained by luminescence detection.

FIG. 2 shows, in block diagram form, the manner in which the image information provided by a color negative film is contemplated to be used. An image scanner 7, as described in FIG. 1, is used to acquire imagewise fluorescence information. As the element 4 is scanned pixel-by-pixel using an array detector, such as an array charge-coupled device (CCD), or line-by-line using a linear array detector, such as a linear array CCD, a sequence of R, G, and B picture element signals are generated that can be correlated with spatial location information provided from the scanner. Signal intensity and location information is fed to a workstation 8, and the information is transformed into an electronic form R', G', and B', which can be stored in any convenient storage device 9.

A video monitor 10, which receives the digital image information modified for its requirements, indicated by R", G", and B", allows viewing of the image information received by the workstation. Instead of relying on a cathode ray tube of a video monitor, a liquid crystal display panel or any other convenient electronic image viewing device can be substituted. The video monitor typically relies upon a picture control apparatus 12, which can include a keyboard and cursor, enabling the workstation operator to provide image manipulation commands for modifying the video image displayed and any image to be recreated from the digital image information.

Any modifications of the image can be viewed as they are being introduced on the video display 10 and stored in the storage device 9. The modified image information R'", G'", and B'". can be sent to an output device 14 to produce a recreated image for viewing. The output device can be any convenient conventional element writer, such as a thermal dye transfer, inkjet, electrostatic, electrophotographic, electrostatic, thermal dye sublimation or other type of printer. CRT or LED printing to sensitized photographic paper is also contemplated. The output device can be used to control the exposure of a conventional silver halide color paper. The output device creates an output medium 16 that bears the recreated image for viewing. It is the image in the output medium that is ultimately viewed and judged by the end user for noise (granularity), sharpness, contrast, and color balance. The image on a video display may also ultimately be viewed and judged by the end user for noise, sharpness, tone scale, color balance, and color reproduction, as in the case of images transmitted between parties on the World Wide Web of the Internet computer network.

Using an arrangement of the type shown in FIG. 2, the images contained in elements in accordance with the invention are converted to digital form, manipulated, and recreated in a viewable form. Film color patches are read to produce R, G, and B image-bearing signals corresponding each color patch. Signal-value patterns of code value pattern generator produces RGB intensity-modulating signals which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors. This transform may be accomplished in a computer by the use of appropriate mathematical manipulations using lookup tables or matrix manipulation. The lookup tables or matrices for this purpose may be generated by appropriate trial exposures of standard color patterns, processing, and image acquisition similar to those used to manipulate the images of conventional transmission images, using the fluorescence intensity from each pixel in place of the transmission density information.

It is to be appreciated that while the images are in electronic form, the image processing is not limited to the specific manipulations described above. While the image is in this form, additional image manipulation may be used including, but not limited to, standard scene balance algorithms (to determine corrections for density and color balance based on the densities of one or more areas within the negative), tone scale manipulations to amplify film underexposure gamma, non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations known in the art. Once the image has been corrected and any additional image processing and manipulation has occurred, the image may be electronically transmitted to a remote location or locally written to a variety of output devices including, but not limited to, silver halide film or paper writers, thermal printers, electrophotographic printers, inkjet printers, display monitors, CD disks, optical and magnetic electronic signal storage devices, and other types of storage and display devices as known in the art.

In yet another embodiment of the invention, the luminance and chrominance sensitization and image extraction article and method described by Arakawa et al in U. S. Pat. No. 5,962,205 can be employed. The disclosures of Arakawa et al are incorporated by reference.

EXAMPLES

Silver Salt Dispersion AgD1:

A stirred reaction vessel was charged with 431 g of lime-processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver Salt Dispersion AgD3:

A stirred reaction vessel was charged with 431 g of lime-processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 l solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl -5-mercaptotetrazole.

Silver Halide Emulsions:

The emulsions employed in these examples are all silver iodobromide tabular grains precipitated by conventional means as known in the art. Table 1 below lists the various emulsions, along with their iodide content (the remainder assumed to be bromide), their dimensions, and the sensitizing dyes used to impart spectral sensitivity. All of these emulsions have been given chemical sensitizations as known in the art to produce optimum sensitivity.

TABLE 1

| Emulsion | Spectral sensitivity | Iodide content (%) | Diameter (μm) | Thickness (μm) | Dyes |
|---|---|---|---|---|---|
| YE-1 | yellow | 1.3 | 0.54 | 0.084 | SD4 |
| ME-1 | magenta | 1.3 | 0.55 | 0.084 | SD1 + SD5 |
| CE-3 | cyan | 2 | 0.24 | 0.24 | SD3 + SD6 |

Developers were ball-milled in an aqueous slurry for 3 days using Zirconia beads in the following formula. For each gram of incorporated developer, 0.2 g of sodium triisopropylnapbthalene sulfonate, 10 g of water, and 25 ml of beads were added. Following milling, the zirconia beads were removed by filtration. The slurry was refrigerated prior to use.

Film samples, Film samples described in this application were prepared in one of two ways. For rapid screening experiments using small amounts of material, a small, mechanized blade-coating device was used. A strip of clear film support (usually subbed 7 mil Estar™) approximately 3 inches wide was threaded over a moveable block equipped with a doctor blade with a 4 mil gap. The strip was clamped tightly at each end so that it was taut. The block was moved to one end of the supported stip. An appropriate melt solution was applied in front of the doctor blade and the block drawn by a pulley arrangement to the other end of the strip. The wet laydown in this device was found to be about 4.5 mL/ft$^2$.

For preparation of film samples on a larger scale, and with greater control over laydown, as well as improved uniformity and coating precision, a single-layer coating machine equipped with an extrusion hopper was used. Multilayer coatings were prepared using multiple passes through the machine.

Photographic exposures. Strips of coated film samples, either 16 mm or 35 mm wide and 12" long, were exposed using an Eastman Intensity Scale Sensitometer, Type 1B. Exposures to evaluate the sensitometric response of the sample were made through a step tablet in contact with the film strip consisting of a graduated range of neutral density patches. Two different step tablets were used: an 11-step 0–3 optical density (OD) tablet and a 21-step 0–4 OD tablet. Various Wratten filters were placed in the light beam to expose the film to light of different colors. The Wratten filters used, including their filter colors and codes, are given in Table 2 below.

TABLE 2

| Exposure color | Filter number |
|---|---|
| Red | WR-24 |
| Green | WR-74 |
| Blue | WR-47 |
| Daylight | DAY VA 5500K for 3000K LAMP with WR-2B |

Thermal Processing. After exposure, the film strips were processed by pulling them slowly through a gap between two heated metal blocks. The transport rate could be controlled to give a residence time in the heated zone of from a few seconds up to 54 seconds, and the temperature of the block controlled between room temperature and about 200° C. Typical process conditions involved residence times of 32 s at 135° C., although these conditions were varied to optimize image discrimination when necessary.

Fluorescence Measurements. Fluorescence sensitometric measurements were carried out either with a spectrofluorimeter (SPEX Fluorolog-2, Horiba, Inc.) equipped with two double monochromators or with a specially constructed apparatus using dichroic interference filters. In the first case, the film sample was supported in the sample compartment sandwiched between two microscope slides perpendicular to the incident light beam. The front slide was equipped with a black mask that restricted the light falling on the strip to a single exposure step. The fluorescence emission was collected in front-face mode (at an angle of 22.5° to the incident beam). A separate emission spectrum (with fixed excitation wavelength) was acquired for each step of the exposed and processed strip, the emission spectrum integrated over a 10–30 nm region, and the integral value reported as the emission intensity. The intensity was plotted either against step number or against the relative exposure (the product of step number and exposure time). The second procedure was used when exposures at more than one time were necessary to span a larger part of the intensity/exposure scale. Notice that the relative exposure scale is valid only for a specific set of exposure conditions, it is not possible to compare the relative exposure with one set of exposure filters (e.g., blue) with that with another (e.g., green).

The specially constructed fluorescence sensitometer consisted of a variable intensity light source, an excitation filter, a film strip holder, an emission filter, and a photodiode light detector together with the appropriate power supplies and detector electronics. The filters were dichroic interference filters obtained from Corion, Inc., with specifications listed in Table 2A.

TABLE 1A

| Filter | Wavelength at peak transmission | Bandwidth at half maximum | Peak transmission |
|---|---|---|---|
| XM430C XM430F | 425 nm +5, −0 | 35 nm ± 3.5 | >50% |
| XM465C XM465F | 460 nm +5, −0 | 35 nm ± 3.5 | >50% |
| XM485C XM485F | 485 nm +0, −5 | 20 nm ± 2.0 | >60% |
| XM535C XM535F | 530 nm +5, −0 | 25 nm ± 2.5 | >60% |
| XM550C XM550F | 550 nm +0, −5 | 10 nm ± 1.0 | >50% |
| XM590C XM590F | 580 nm +5, −0 | 20 nm ± 2.0 | >65% |
| XM635C XM635F | 630 nm +5, −0 | 35 nm ± 3.5 | >65% |
| XM650C XM650F | 645 nm +5, −0 | 40 nm ± 4.0 | >65% |

Two different illumination/observation geometries were used, depending on the film structure being investigated. Most observations, used invariably on transparent or translucent film strips, were carried out in a linear transmission mode, in which the light source, emission filter, film strip holder, excitation filter and detector were arranged in that order along a single optical axis (transmission geometry). For opaque samples, the film strip was illuminated at an oblique angle (about 45°) through the excitation filter; the emission was collected normal to the film on the same side (front face geometry). For the appropriate combinations of excitation and emission filters, the transmission of excitation light by the emission filter was very low, so that background due to crosstalk was generally negligible relative to the fluorescence signal arising from the film. Light intensities were recorded as optical power at the detector, measured in watts. Generation of sensitometric data was achieved by recording the emitted intensity at each step of an exposed and processed strip.

The structures of compounds used in the Examples are represented below in Table 3 (Developers), Table 4 (Fluorescent Dyes), Table 5 (Sensitizing Dyes), Table 6 (Melt Formers or plasticizers), Table 7 (Silver Donors).

TABLE 2

| Developer name | Structure |
|---|---|
| Dev1 | 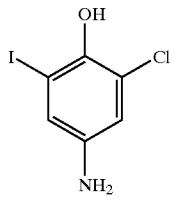 |

TABLE 2-continued
| Developer name | Structure |
|---|---|
| Dev2 | 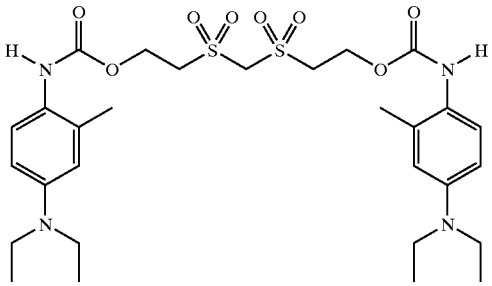 |
TABLE 2-continued
| Developer name | Structure |
|---|---|
| Dev3 | 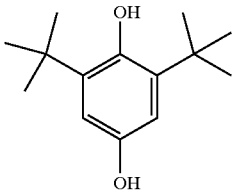 |
| Dev4 | 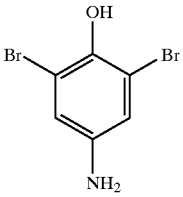 |
TABLE 3
| Dye name | Structure |
|---|---|
| FD1 | 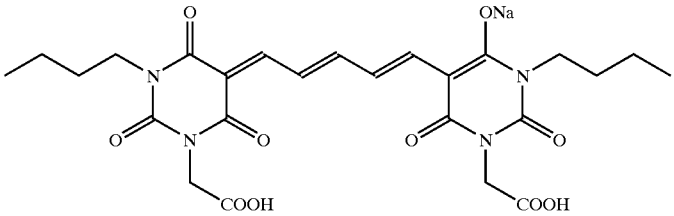 |
| FD2 | 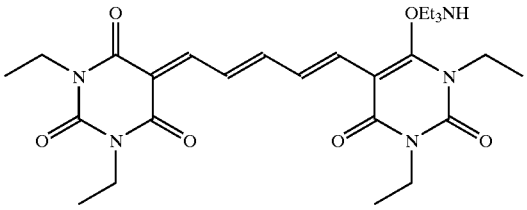 |
| FD3 | 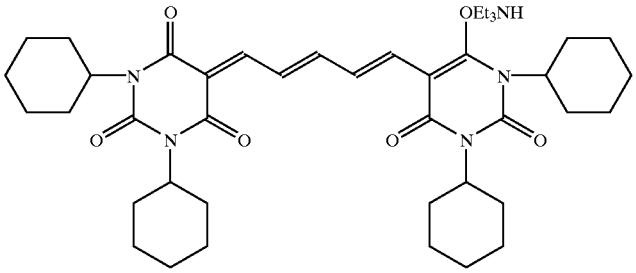 |
| FD4 | 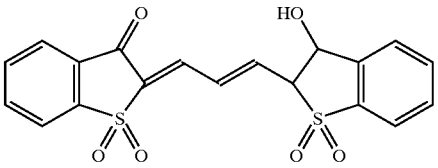 |

TABLE 3-continued
| Dye name | Structure |
|---|---|
| FD5 | 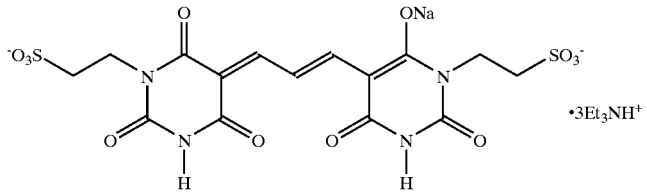 |
| FD6 | 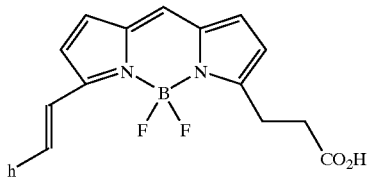 |
| FD7 | 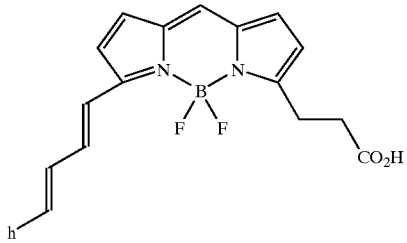 |
TABLE 4
| Dye name | Structure |
|---|---|
| SD1 | 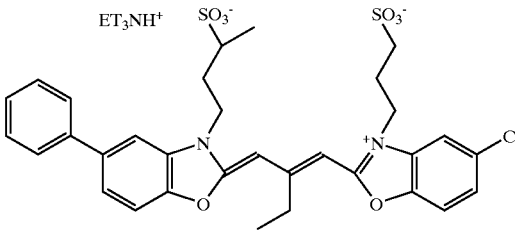 |
| SD2 | 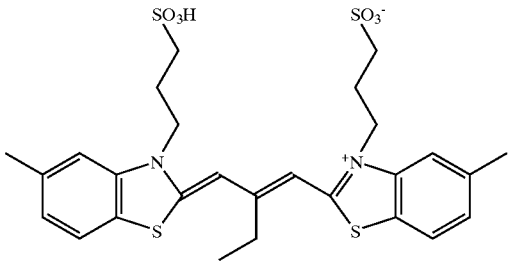 |
TABLE 4-continued
| Dye name | Structure |
|---|---|
| SD3 | 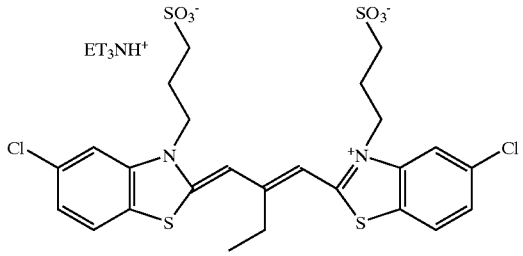 |
| SD4 | 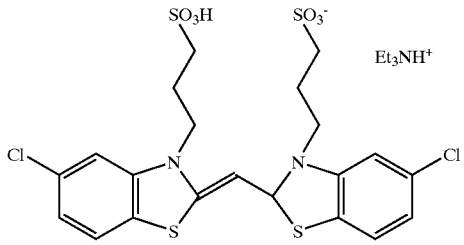 |

TABLE 4-continued

| Dye name | Structure |
|---|---|
| SD5 | 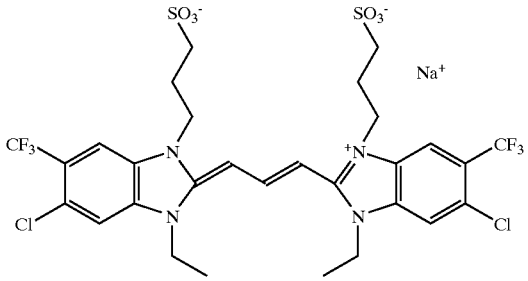 |
| SD6 | 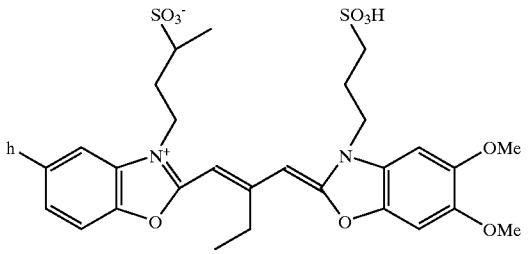 |
| SD7 | 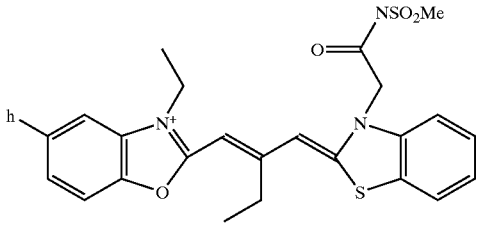 |

TABLE 5

| Plasticizer name | Structure |
|---|---|
| MF1 | 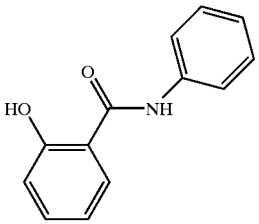 |
| MF2 | 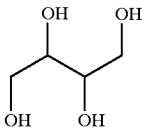 |
| MF3 | 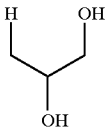 |

TABLE 5-continued

| Plasticizer name | Structure |
|---|---|
| MF4 | 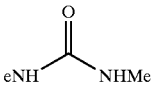 |

TABLE 6

| Silver Donor name | Structure |
|---|---|
| AgD1 | 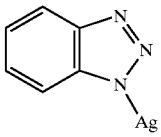 |
| AgD3 | 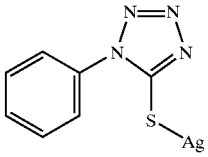 |

Example 1

A two-layer coating was prepared by application of appropriate coating melts using an extrusion hopper (X-hopper) coating machine to achieve the coating structure indicated in Table 8. The overcoat layer provided a vehicle for the hardener as well as scratch protection during thermal processing.

TABLE 7

| Layer | Component | Laydown/mg. $ft^{-2}$ |
|---|---|---|
| Support | subbed 0.007" Estar ™ polyester | — |
| Layer 1 (emulsion layer) | CE2 | 40 |
| | FD3 | 0.050 |
| | AgD1 | 30 |
| | Dev1 | 10 |
| | MF1 | 70 |
| | MF2 | 80 |
| | MF3 | 40 |
| | Gelatin | 400 |
| Layer 2 (overcoat) | Gelatin Hardener | 10 |
| | MF2 | 53 |
| | MF3 | 25 |
| | Gelatin | 250 |

Fluorescent dye FD3 was added to the melt as an oil-in-water emulsion. The dye (0.003 g) was dissolved in a mixture of 17.0 g diethyllauramide, 2.1 g dioctylphthalate, and 0.0012 g of dimethyldodecylammonium chloride. After the dye was dissolved the solution was added to a mixture of 203 g 11.57% Type IV photographic gelatin, 9.9 g of 10% Alkanol XC® in water (Alkanol XC® is an anionic surfactant produced by DuPont de Nemours, Inc.). The mixture was shaken thoroughly by hand, and subjected to sonication for 90 sec in a Heat Systems Sonicator XL® mixer operating at 450 W. An appropriate amount of this dispersion was added to the coating melt to achieve the desired laydown, as listed in Table 8 above.

Exposure: 0.5 s to red light using a 21-step 0–4 OD step tablet.

Processing: 32s at 135° C.

Measurement: transmission mode in filter fluorimeter using XM550F as the excitation filter and XM65OF as the emission filter.

Figure 3:
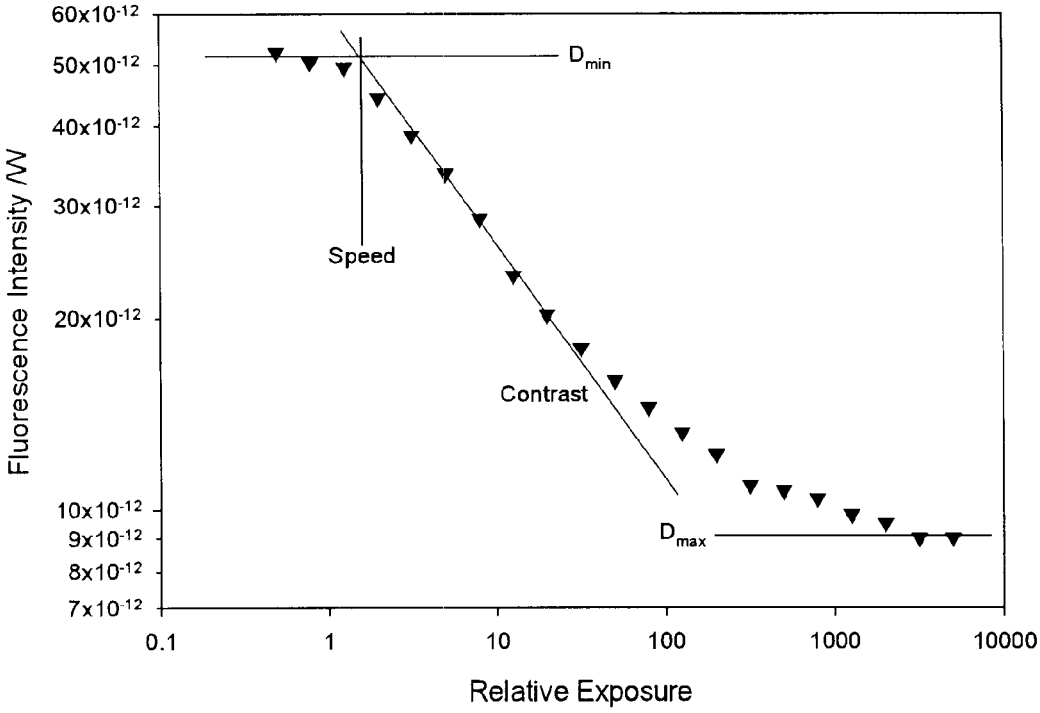
FIG. 3 shows the results of fluorescence measurements in Example 1 below, in which there is a strong modulation of the fluorescence emission as a function of the red-light exposure of the film, demonstrating that a thermally processed fluorescent film according to the present invention effectively generates imaging information.

The results of the fluorescence measurements are shown in FIG. 3. Clearly there is a strong modulation of the fluorescence emission as a function of the red-light exposure of the film, demonstrating that a thermally processed fluorescent film is capable of generating imaging information.

This example illustrates the numerical parameters that are used to describe imaging performance in this work. The fluorescence intensity in the absence of appreciable exposure is the Dmin value; it is desirable that this intensity be as large as possible to facilitate detection and measurement of the fluorescence from the film. Dmax is the intensity at maximum exposure. The ratio Dmin/Dmax is the image discrimination (ID), a figure of merit describing the available range of intensities afforded by a given film structure, processing condition, and exposure. When plotted on a logarithmic scale, as in FIG. 3, the latitude of the film can be greater than the exposures afforded by the step tablet, with the result that a plateau value for either or both of Dmin and Dmax is not achieved. In this case the ID was frequently estimated as the ratio of the intensity at step 0 (the most opaque step, corresponding roughly to Dmin) and the last step (usually step 21; corresponding to Dmax). The utility of the ID parameter in these cases merely demonstrates that imaging has occurred, and gives a rough measure of how effective it is. In some cases below, Dmax and Dmin are reported relative to the input light intensity, that is, relative to the signal recorded in the absence of both film strip and emission filter. In this case, Dmax and Dmin are unitless, and are corrected partially for variations in the lamp output. The contrast is the slope of the plot of log(Fluorescent Intensity) vs. log(Exposure), and the speed is defined as the relative exposure at point of intersection between the line defining the contrast and that defining Dmin.

In the case illustrated, the intensity at Dmin is about $5.0\times10^{-11}$ W, that at Dmax is about $8.3\times10^{-12}$ W, the ID is about 6.0, the relative speed is about 15, and the contrast is 0.37 (dimensionless).

Example 2

Coatings were prepared as in Example 1, except that the fluorescent dye dispersion was omitted, and the emulsion of Example was replaced with three different emulsions sensitized with different fluorescent sensitizing dyes. The emulsions were coated at 40 mg/ft$^2$, and had characteristics shown in Table 9.

TABLE 9

| Emulsion | Size | Sensitizing dyes |
|---|---|---|
| YE1 | 0.55 μm × 0.084 μm (tabular grain) | SD4 |
| ME1 | 0.55 μm × 0.084 μm (tabular grain) | SD1 + SD5 |
| CE1 | 0.24 μm | SD3 + SD6 |

Exposure: 21-step 0–4 OD step tablet

YE1: 2.0 s to blue light.

ME1: 10 s to green light.

CE1: 0.5 s to red light.

Processing: 32s at 135° C.

Measurement: Transmission mode in filter fluorimeter using the following filters YE1: XM430F (excitation filter) and XM485F (emission filter).

ME1: XM485F (excitation filter) and XM535F (emission filter).

CE1: XM55OF (excitation filter) and XM65OF (emission filter).

The following fluorescence sensitometric results for the coatings in Table 10 below were obtained:

TABLE 10

| Emulsion | Dmin* | ID | Contrast | Speed |
|---|---|---|---|---|
| YE1 | $6.0\times10^{-3}$ | 3.0 | 0.15 | 12 |
| ME1 | $7.3\times10^{-5}$ | 4.4 | 0.21 | 181 |
| CE1 | $7.0\times10^{-5}$ | 8.8 | 0.35 | 1.2 |

*Ratio of recorded intensity to input intensity (the power incident on the detector in the absence of the coating and the emission filter).

These examples show that it is possible to use a sensitizing dye as a fluorescent dye in order to obtain an image. The sensitizing dyes of Table 9 are sufficiently fluorescent after thermal processing to yield a readily detectable signal.

Example 3

Single layer hand coatings were prepared under red safelight conditions with the following general coating structure shown in Table 11:

TABLE 11

| Layer | Component | Laydown /mg. ft$^{-2}$ |
|---|---|---|
| Support | subbed 0.007" Estar ® polyester | — |
| Layer 1 | YE1 | 33 |
| | Fluorescent dye | 0.043 |
| | AgD1 | 25 |
| | AgD3 | 4 |
| | Dev1 | 77 |
| | MF1 | 66 |
| | Gelatin | 330 |

A variety of fluorescent oxonol dyes were added to the coating solutions before application to the support, as solutions either in water or methanol depending on the dye solubility. The coatings were allowed to dry, exposed for 1 s using a Daylight filter and an 11-step 0–3 step tablet, and then developed for 32 s at 125° C. The fluorescence sensitometry was obtained using the SPEX spectrofluorimeter, with the results shown in Table 12.

TABLE 12

| Fluorophore | Excitation wavelength/nm | Emission band/ nm | Image Discrimination |
|---|---|---|---|
| FD1 | 590 | 610–645 | 8.2 |
| FD2 | 590 | 615–635 | 18.8 |
| FD4 | 535 | 560–580 | 4.1 |
| FD5 | 480 | 505–535 | 13.6 |

These results show that all of these dyes showed the ability to form an easily detectable fluorescent image under these conditions, when the dye is incorporated as a molecularly dispersed material in aqueous solution.

Example 4

Single layer hand coatings were prepared under red safelight conditions with the following general coating structure in Table 13:

TABLE 13

| Layer | Component | Laydown /mg. $ft^{-2}$ |
|---|---|---|
| Support | subbed 0.007" Estar ® polyester | — |
| Layer 1 | YE1 | 37 |
| | AgD1 | 24 |
| | Dev1 | 9.6 |
| | MF1 | 62 |
| | MF2 | 94 |
| | Gelatin | 340 |
| | Har1 | 6 |

A variety of fluorescent dyes were added to the coating solutions before application to the support as oil-in-water dispersions in diethyllauramide, prepared according to the general procedure described in Example 1. The coatings were allowed to dry, exposed for 1 s using a Daylight filter and an 11-step 0–3 step tablet, and then developed for 32 s at 125° C. The fluorescence sensitometry was obtained using the SPEX spectrofluorimeter, with the results shown in Table 14.

TABLE 14

| Fluorophore | Laydown/ $mg/ft^2$ | Excitation wavelength/nm | Emission band/nm | ID |
|---|---|---|---|---|
| FD1 | 0.053 | 590 | 610–645 | 3 |
| FD4 | 0.053 | 535 | 560–580 | 7 |
| FD6 | 0.038 | 535 | 656–605 | 12 |
| FD7 | 0.038 | 560 | 590–630 | 18 |

These data illustrate that trimethine oxonol dyes as well as borazole dyes are effective fluorophores in the invention. These results taken with those of Example 1 also show that water insoluble dyes can be incorporated as oil-in-water dispersions.

Example 5

Single layer hand coatings were prepared under red safelight conditions with the following general coating structure:

TABLE 15

| Layer | Component | Laydown/mg. $ft^{-2}$ |
|---|---|---|
| Support | subbed 0.007" Estar ® polyester | — |
| Layer 1 | YE1 | 37 |
| | FD4 | 0.040 |
| | AgD1 | 24 |
| | Developer | Variable |
| | MF1 | 73 |
| | MF2 | 85 |
| | Gelatin | 380 |

Various developing agents were incorporated into the coating, as ball-milled, solid particle dispersions. The ball-milled dispersions were prepared by the following general procedure. The solid developer (9.6 g) was suspended in a mixture of 71.25 g water, 17.22 g of a 10% solution of Triton X200® (a surfactant produced by Olin-Matheson, Inc.), 0.98 g poly(vinylpyrrolidone) (MW ca. 40,000 kD) and 250 mL of 1.0–1.25 mm Zirconium Oxide beads in a glass jar with a screw-top lid. The mixture was rolled on a ballmill for 2 days, at which time the milled suspension was separated from the ZrO2 beads by filtration through wire mesh. The resulting suspension was considered to contain 9.6% active developer. The developers were added to the coating at a constant molar laydown of 0.04 $mmoles/ft^2$, except for Dev2, which was coated at 0.02 $mmoles/ft^2$.

The coatings were allowed to dry, exposed for 1 s using a Daylight filter and an 11-step 0–3 step tablet, and then developed for 32 s at 125° C. The fluorescence sensitometry was obtained using the SPEX spectrofluorimeter, with the results for image discrimination shown in Table 16.

TABLE 16

| Developer | Laydown/$mg/ft^2$ | Image Discrimination |
|---|---|---|
| Dev1 | 6.8 | 5.8 |
| Dev2 | 14.7 | 2.8 |
| Dev3 | 16.5 | 2.0 |
| Dev4 | 6.8 | 6.0 |

Each of these developers yielded a detectable fluorescence image scale, though under the chosen processing conditions, the aminophenol developers (Dev1 and Dev4) are more active than either the blocked p-phenylene diamine developer (Dev2) or the dialkylhydroquinone derivative (Dev3).

Example 6

Machine coatings were prepared with the coating structure listed in Table 17 below. These coatings are identical to those of Example 1 except for the inclusion of an initial coating layer (next to the support) containing an antihalation pigment, consisting either of 30 $mg/ft^2$ carbon black particles or 300 $mg/ft^2$ titanium oxide particles, both of which were suspended in gelatin for incorporation into the coating melt.

TABLE 17

| Layer | Component | Laydown /mg. $ft^{-2}$ |
|---|---|---|
| Support | subbed 0.007" Estar ® polyester | — |
| Layer 1 | Pigment | as noted |
| | MF2 | 64 |
| | MF3 | 31 |
| | Gelatin | 300 |
| Layer 2 | CE2 | 38 |
| | FD3 | 0.050 |
| | AgD1 | 29 |
| | Dev1 | 9.8 |
| | MF1 | 68 |
| | MF2 | 83 |
| | MF3 | 39 |
| | Gelatin | 412 |
| Layer 3 | Gelatin Hardener | 10 |
| | MF2 | 53 |
| | MF3 | 25 |
| | Gelatin | 250 |

The coatings were allowed to cure at room temperature for several days prior to use. Samples of the coatings were then exposed (red light, 0.5 s) using a 21 step 0–4 OD step tablet. They were processed by heating to 135° C. for 32 s. Fluorescence sensitometry was measured using interference filters (X.M550F excitation and XM650F emission) in front face mode, wherein the excitation light illuminated the coating from an angle of about 30° and the emitted light was collected in a direction normal to the film. The control coating is that of Example 1. The results for the fluorescence sensitometry in front-face mode are shown in Table 18. (The Relative Sensitivity is a measure of the amount of light necessary produce a detectable image, so that a smaller number indicates a more sensitive element.)

TABLE 18

| Sample | Pigment in Layer 1 | $D_{min}/10^{-11}$ W | Contrast | Relative Sensitivity |
|---|---|---|---|---|
| 1 | Carbon black | 0.89 | 0.24 | 1.6 |
| 2 | None (Example 1) | 297 | 0.40 | 1.4 |
| 3 | Titanium oxide | 6.45 | 0.46 | 0.8 |

The data in Table 18 illustrate that the use of a white titanium oxide reflective layer gives higher fluorescence intensity at Dmin than either a black antihalation layer or no underlayer, as well as higher contrast (indicating better imaging) and an improvement in the sensitivity of the film to light (Relative Sensitivity) by a factor of 2.

The fluorescence sensitometry of these exposed and processed coatings was also recorded in transmission mode, in which the light source, excitation filter, film strip, emission filter, and detector were arranged in a co-linear fashion. The results for the fluorescence sensitometry in transmission mode are shown in Table 19.

TABLE 19

| Undercoat | $D_{min}/10^{-11}$ W | Contrast | Relative Sensitivity |
|---|---|---|---|
| Carbon black | 4.61 | 0.158 | 2.45 |
| None (Example 1) | 82.8 | 0.231 | 1.70 |
| Titanium oxide | 67.2 | 0.337 | 0.81 |

These results are not directly comparable to those of Table 19, because the input light intensity is not the same in the two cases. The fluorescence intensity from Dmin in the Titanium oxide coating is only slightly less than that of the coating with no pigmented layer, in spite of the attenuation of the exciting light by the scattering in this layer. The emission intensity from the coating with carbon black is substantially diminished (at a constant input light intensity) by absorption of light by the black pigment in this layer. Both contrast and speed as measured in transmission mode are similar to those measured in front face mode. In particular, the Relative Sensitivity of the coating over titanium oxide is smallest (i.e., the film is more sensitive to light) and the contrast is highest of the three structures.

Example 7

A two color (bichrome) record film was prepared with the structure shown in Table 20 below. The layers were applied one at a time in four successive passes using the X-hopper coating machine.

TABLE 20

| Layer | Component | Laydown/mg. $ft^{-2}$ |
|---|---|---|
| Support | subbed 0.007" Estar ® polyester | — |
| Layer 1 | ME1 | 40 |
| | AgD1 | 25 |
| | Dev1 | 9.7 |
| | MF1 | 67 |
| | MF2 | 83 |
| | MF3 | 38 |
| | Gelatin | 381 |
| Layer 2 | YFD | 7.5 |
| | MF2 | 22 |
| | MF3 | 10 |

TABLE 20-continued

| Layer | Component | Laydown/mg. $ft^{-2}$ |
|---|---|---|
| | Gelatin | 100 |
| Layer 3 | YE1 | 40 |
| | AgD1 | 25 |
| | Dev1 | 9.7 |
| | MF1 | 67 |
| | MF2 | 83 |
| | MF3 | |
| | Gelatin | 381 |
| Layer 4 | Gelatin Hardener | 17.4 |
| | MF2 | 50 |
| | MF3 | 25 |
| | Gelatin | 250 |

Eight samples of this coating were exposed by flash-down exposures as described in the following Table 21:

TABLE 21

| Sample Number | Exposure in blue | Exposure in green |
|---|---|---|
| 1 | 40s, 21 step 0–4 density | 0s |
| 2 | 40s, 21 step 0–4 density | 0.04s |
| 3 | 40s, 21 step 0–4 density | 0.5s |
| 4 | 40s, 21 step 0–4 density | 10s |
| 5 | 0s | 40s, 21 step 0–4 density |
| 6 | 0.04s | 40s, 21 step 0–4 density |
| 7 | 0.5s | 40s, 21 step 0–4 density |
| 8 | 10s | 40s, 21 step 0–4 density |

The fluorescence signals were collected imagewise from each coating using filters XM430C and XM485C for recording the blue record fluorescence signal, and filters XM485C and XM535C were used to collect the green record fluorescence signal. The resulting recorded fluorescence intensities were fitted three dimensions as green exposure vs. blue exposure vs intensity using the following equation:

$$I = \frac{a - a_o}{\left[1 + \left(\frac{x - x_o}{b_o + b_1(y - y_o)}\right)^2\right]\left[1 + \left(\frac{y - y_o}{c_o + c_1(x - x_o)}\right)^2\right]} + a_o$$

where I is the (background corrected) measured intensity, x is the blue exposure as step number and y is the green exposure as step number. The other parameters have the following meaning:

| | |
|---|---|
| $A_o$ | intensity at $D_{max}$ |
| a | intensity at $D_{max}$ |
| $x_o$ | blue step number at $D_{min}$ intensity |
| $y_o$ | green step number at $D_{min}$ intensity |
| $b_o$ | a value that can be viewed as representative of the blue speed point when the equation is statistically fitted to the data |
| $c_o$ | a value that can be viewed as representative of the green speed point when the equation is statistically fitted to the data |
| $b_1$ | a value that can be viewed as representative of the effect of the green exposure on the blue speed point when the equation is statistically fitted to the data |
| $c_1$ | a value that can be viewed as representative of a second order effect of the green exposure on the green speed point when the equation is statistically fitted to the data. |

Figure 4:
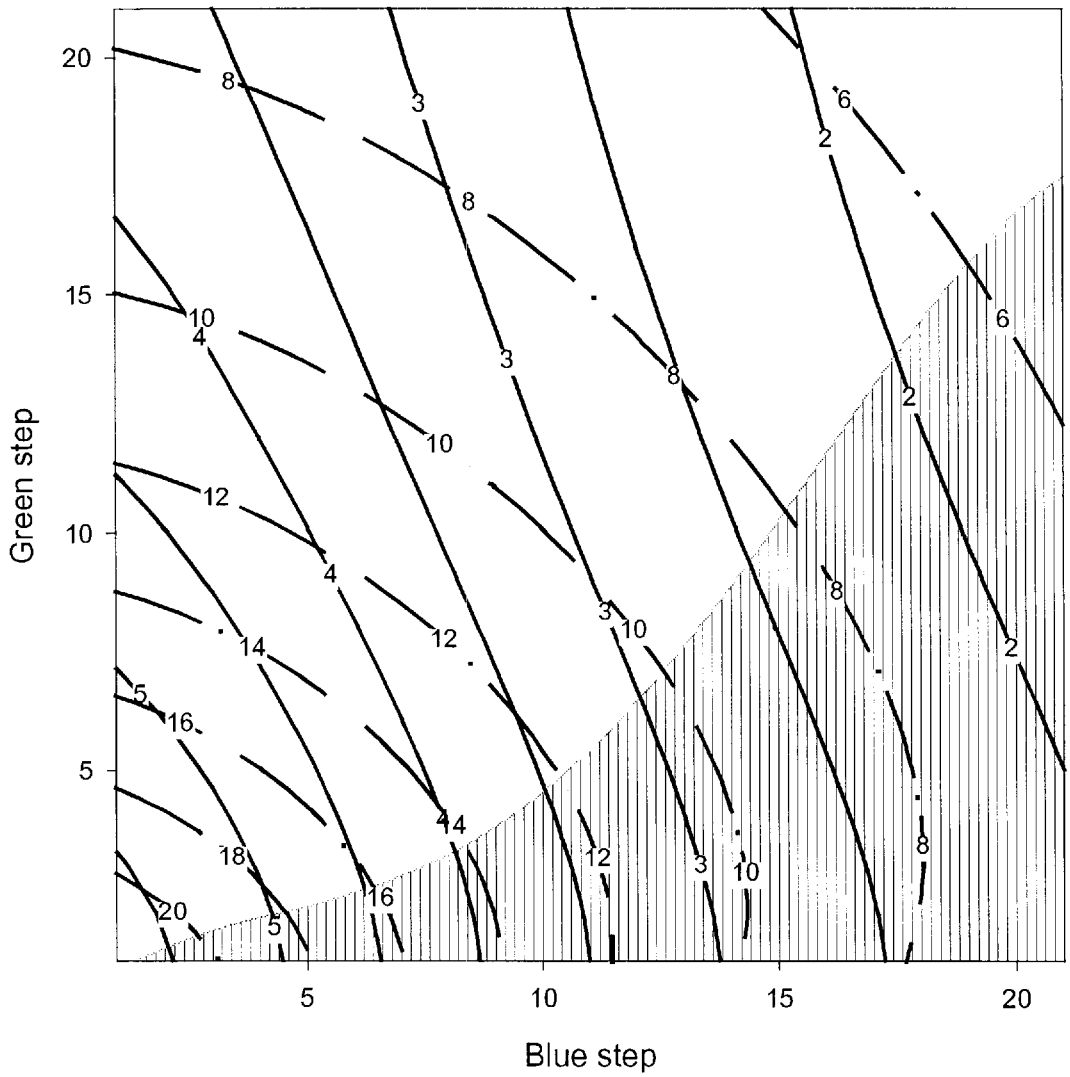
FIG. 4 shows the results of Example 7 below in the form of superimposed contour plots, wherein bichrome fluorescence data is presented as with solid lines corresponding to a blue record, with dashed lines corresponding to a green record, and with intensities (in multiples of $10^{-11}$ W) indicated by the numbers on the appropriate contour line, wherein the solid or dashed lines represent levels of constant measured emission.

The terms in b1 and c1 can be viewed as accounting for the "cross-talk" between the layers on the speed position. Two such equations, with two sets of parameters, were separately derived for the intensities measured for the blue and green records. The fits to the data are shown as superimposed contour plots in FIG. 4. Specifically, in FIG. 4, the bichrome fluorescence data is presented as follows: solid lines: blue record, dashed lines: green record. Intensities (in multiples of $10^{-11}$ W) are indicated by the numbers on the appropriate contour.

In this Figure, the solid lines represent levels of constant emission using the XM485C and XM535C filter pair, i.e., from the blue record, whereas the dashed lines represent similar levels recorded using the XM430C and XM485C filter pair, i.e., from the green record. If the intensities of the emission from the blue and green records were unaffected by the exposure level in the other layer, the solid lines would be parallel to the Green step axis (that is, would not depend on Blue exposure) and the dashed lines would correspondingly be parallel to the Blue step axis. However, since the green record is observed through the blue record, and since the intensity of the blue emission is affected by the degree of exposure to green light to an appreciable extent, the lines on the plot are not orthogonal. Instead each set of lines show some dependence on the exposure level in both records, and therefore the lines are not parallel to either axis.

The existence of a region in the upper left of FIG. 2, in which the intensity of the fluorescence signals in green and blue are nearly independent (that is, have contours that are not parallel, and do not have multiple crossings) demonstrate that in principle it is possible to abstract the exposure level from separate measurements of fluorescence intensities of the emission from the two different records. In other words, it is possible in principle to recreate the color intensity information in the original scene from the fluorescence measurements that lie in the upper left of the FIG. 4. This kind of reconstruction is not possible in the lower right (the shaded part of FIG. 4). This example therefore demonstrates in principle the ability to make multicolor digital images from information recorded in the superimposed layers of a fluorescent thermally processed film.

Example 8

A 35mm film strip made from Sample 3 of Example 6 (that is, a monochrome imaging layer using a red-sensitive emulsion and containing fluorophore FD3 coated over a titanium dioxide reflective layer) was loaded into a single-lens reflex camera. The camera was used to photograph both a MACBETH COLOR CHECKER color chart (obtained from GietagMacbeth, Inc.), and also an image of a person. The COLOR CHECKER color chart is a test object that includes, among other features, a series of neutral density patches of known reflection density. Exposure times between 0.25 and 4 seconds were used. After exposure, the film strip was removed from the camera and thermally processed (32 s, 135° C.). The exposed and processed strip was mounted in a strip holder, and illuminated from the back (through the $TiO_2$ layer) using light passed through an XM550 dichroic filter. The emitted light from the emulsion side of the film was imaged through a XM650 dichroic filter onto a CCD array to obtain a digital record of the fluorescence image (20 s acquisition time). The digital image was processed using Adobe Photoshop(R) software to adjust the contrast, and printed using an inkjet printer. A reasonable image of the scene was obtained by this process, with good resolution of fine detail in the image. From the image of the COLOR CHECKER color chart, a rough intensity vs. exposure scale could be obtained, as shown in Table 22, showing pixel gray scale value (0=black, 256=white) versus reflection density for the MACBETH COLOR CHECKER color chart neutral color patch.

TABLE 22

| Reflection Density | Average Pixel value |
|---|---|
| 1.50 | 64.5 |
| 1.05 | 74.3 |
| 0.70 | 93.7 |
| 0.44 | 108.5 |
| 0.23 | 131.2 |
| 0.05 | 168.5 |

These data demonstrate that a thermally processable fluorescent film is capable of recording useful image information that can be captured and digitized using a CCD array scanner. Further, the data show that a fluorescent film coated over a reflective layer can yield a reasonably sharp, high resolution image, and that useful image information can be obtained by illumination through the reflective layer.

What is claimed is:

1. A photographic recording process employing a film comprising at least one imaging layer comprising a light-sensitive silver-halide emulsion, binder, an incorporated developer or developer precursor, and at least one fluorophore capable of luminescence, which method in order comprises:

(a) imagewise exposing the film in a camera;

(b) thermally developing the film comprising heating said film to a temperature greater than 80° C. in an essentially dry process, such that the incorporated developer or a developer formed from a developer precursor in reactive association with the exposed silver-halide in the silver-halide emulsion forms a silver image and a fluorescent latent image, (c) detecting the fluorescent latent image in the film without desilvering or fixing the film by illuminating the film with a substantially monochromatic light of a wavelength suitable for the excitation of the luminescence of said fluorophore to produce a luminescent signal of a different wavelength band, the emitted light; and measuring the imagewise intensity of the luminescent signal to produce an electronic image record capable of generating an image in a hard or soft display element.

2. The photographic recording process of claim 1 wherein the film is uniformly illuminated across the image area by the substantially monochromatic light and measuring the imagewise intensity of the luminescent signal with a optical detector comprising a CCD or other electronic light sensor to produce an electronic image record capable of generating an image in a hard or soft display element.

3. The photographic recording process of claim 1 wherein the exciting illumination is a moving beam of light.

4. The photographic recording process of claim 3 wherein the moving beam of light is produced by a laser.

5. The photographic recording process of claim 2 wherein the optical detector is a CCD array device or a line detector device.

6. The photographic recording process of claim 1 wherein the optical detector is a photodiode or photomultiplier tube.

7. The process of claim 1 wherein the fluorophore is used in the amount of $10^{-9}$ to $10^{-3}$ mol/m$^2$ in said imaging layer.

8. The process of claim 1 wherein the amount of silver in the imaging layer is 0.04 g/m$^2$ to 4 g/m$^2$.

9. The process of claim 1 wherein the film comprises an imaging layer coated on a translucent reflective base layer and wherein the film is illuminated through the base layer during detection of the fluorescent latent image and wherein the emitted light is detected from the side opposite the source of the excitation light.

10. The photographic recording process of claim 1 wherein illumination and detection occur on opposite sides of the film.

11. The photographic recording process of claim 1 wherein the film has multiple light-sensitive units which have their individual sensitivities in different wavelength regions, each of the units comprising at least one imaging layer comprising a light-sensitive silver-halide emulsion, binder, an incorporated developer or developer precursor, and at least one fluorophore capable of luminescence.

12. The photographic recording process of claim 11, wherein the illumination and detection occurs on either or both sides of the film.

13. The photographic recording process of claim 1, in which there is a straight line optical path between the illuminant source and the detector.

14. The photographic recording process of claim 1, wherein imagewise transmittance of the film is also detected.

15. The photographic recording process of claim 14, wherein the transmitted light is white light.

16. The process of claim 1, wherein an interference filter is used in the optical path between the film and the detector in order to isolate the emitted light in the presence of the scattered or transmitted exciting light.

17. The process of claim 16, wherein an interference filter is also used in the optical path between the light source and the film to provide the substantially monochromatic light of a wavelength suitable for the excitation of the luminescence of said fluorophore.

18. The process of claim 1 wherein the photographic recording material has a transparent or translucent substrate that allows the passage of a beam of monochromatic light of a wavelength suitable for the excitation of the luminescence.

19. The process of claim 11 wherein the imaging layers of three different colors are developed and detected as in (b) and (c).

20. The process of claim 1, where the fluorophore is uniformly distributed separately from silver halide crystals in the imaging layer and is not used to sensitize the silver halide.

21. The process of claim 1, where the fluorophore is a spectral sensitizer absorbed on silver halide in the imaging layer.

22. The process of claim 1, wherein the fluorophore exhibits a molar extinction coefficient greater than $10^4$ liters/mole-cm.

23. The process of claim 1, wherein the fluorophore exhibit high quantum yield for emission of greater than ten percent.

24. The process of claim 1, wherein the Stokes shift of the fluorophore is greater than 30 nanometers.

25. The process of claim 1, wherein the fluorophore exhibit absorption band of less than 100 nm.

26. The process of claim 1, wherein the fluorophore exhibits an emission band of less than 150 nm.

27. The method of claim 1 wherein the developer precursor is a blocked developing agent that forms an oxidized developing agent that develops the silver halide latent image to form a silver image and, at the same time, produces a latent luminescence image.

28. The method of claim 1 wherein the initial detection is in a kiosk.

29. The method of claim 11, wherein a color print is generated by thermal-diffusion or ink-jet printing.

30. The method of claim 1 wherein step (c) comprises the following steps:

forming an analog electronic representation of said developed image;

digitizing said analog electronic representation to form a digital image;

digitally modifying said digital image; and storing, transmitting, printing, or displaying said modified digital image.

31. A photographic recording process employing a film comprising at least one imaging layer comprising a light-sensitive silver-halide emulsion, binder, an incorporated developer or developer precursor, and at least one fluorophore capable of luminescence, wherein the fluorophore is used in the amount of $10^{-9}$ to $10^{-3}$ mol/m$^2$ in said imaging layerwhere the fluorophore is uniformly distributed separately from the silver halide crystals in the imaging layer and is not used to sensitize the silver halide and wherein the fluorophore exhibits a molar extinction coefficient greater than $10^4$ liters/mole-cm and a quantum yield for emission of greater than ten percent, and a Stokes shift of the fluorophore is greater than 30 nanometers, which method in order comprises:

(a) imagewise exposing the film in a camera;

(b) thermally developing the film comprising heating said film to a temperature greater than 80° C. in an essentially dry process, such that the incorporated developer or a developer formed from a developer precursor in reactive association with the exposed silver-halide in the silver-halide emulsion forms a silver image and a fluorescent latent image, detecting the fluorescent latent image in the film without desilvering or fixing the film by illuminating the film with a substantially monochromatic light of a wavelength suitable for the excitation of the luminescence of said fluorophore to produce a luminescent signal of a different wavelength band, the emitted light; and measuring the imagewise intensity of the luminescent signal to produce an electronic image record capable of generating an image in a hard or soft display element.

32. A photographic recording process employing a film comprising at least one imaging layer comprising a light-sensitive silver-halide emulsion, binder, an incorporated developer or developer precursor, and at least one fluorophore capable of luminescence, which method in order comprises:

(a) imagewise exposing the film in a camera;

(b) thermally developing the film comprising heating said film to a temperature greater than 80° C. in an essentially dry process, such that the incorporated developer or a developer formed from a developer precursor in reactive association with the exposed silver-halide in the silver-halide emulsion forms a silver image and a fluorescent latent image, detecting the fluorescent latent image in the film without desilvering or fixing the film by illuminating the film with a substantially monochromatic light of a wavelength suitable for the excitation of the luminescence of said fluorophore to produce a luminescent signal of a different wavelength band, the emitted light; and measuring the imagewise intensity of the luminescent signal to produce an electronic image record capable of generating am image in a hard or soft display element, wherein there is a straight line optical path between the illuminant source and the detector and an interference filter is used in the optical path between the film and the detector in order to isolate the emitted light in the presence of the scattered or transmitted exciting light and wherein an interference filter is also used in the optical path between the light source and the film to provide the substantially monochromatic light of a wavelength suitable for the excitation of the luminescence of said fluorophore.

33. The photographic recording process of claim 32 employing a color film having multiple light-sensitive units which have their individual sensitivities in different wavelength regions, each of the units comprising at least one imaging layer comprising a light-sensitive silver-halide emulsion, binder, an incorporated developer or developer precursor, and at least one fluorophore capable of luminescence.

34. A photothermographic film comprising at least one imaging layer comprising a light-sensitive silver-halide emulsion, binder, an incorporated developer or developer precursor, and at least one fluorophore capable of luminescence , wherein the fluorophore is used in an amount of $10^{-9}$ to $10^{-3}$ mol/$m^2$in said imaging layer and wherein the fluorophore is uniformly distributed separately from silver-halide crystals in the imaging layer and is not used to sensitize the silver halide, and wherein the fluorophore exhibits a molar extinction coefficient greater than $10^4$ liters/mole-cm and a quantum yield for emission of greater than ten percent, and a Stokes shift greater than 30 nanometers, such that the incorporated developer or a developer formed from a developer precursor in reactive association with the exposed silver-halide in the silver-halide emulsion forms a silver image and a fluorescent latent image.

35. The photothermographic film of claim 34, wherein the film comprises a red-light-sensitive-layer unit, a green-light-sensitive layer unit and a blue-light-sensitive layer unit.

36. The photothermographic film of claim 34, wherein the film, after imagewise exposure, is capable of being developed by heat treatment.

37. A photothermographic film according to claim 34 wherein the photothermographic film further comprises a non-light sensitive organic silver salt.

38. The photothermographic film according to claim 34 that is capable of dry development without the application of aqueous solutions.

39. A photothermographic film according to claim 34 wherein the photothermographic film further comprises a combination of salicylanilide and low molecular weight polyol selected from the group consisting of ethylene glycol, glycerol, erythritol, and threitol, mannitol, and combinations thereof.

* * * * *